US007194954B2

(12) United States Patent
Winston

(10) Patent No.: US 7,194,954 B2
(45) Date of Patent: Mar. 27, 2007

(54) CONTINUOUS INK STAMPING SYSTEMS AND METHODS

(75) Inventor: Jeffrey M. Winston, Anacortes, WA (US)

(73) Assignee: Clearsnap Holding, Inc., Anacortes, WA (US)

( * ) Notice: Subject to any disclaimer, the term of this patent is extended or adjusted under 35 U.S.C. 154(b) by 144 days.

(21) Appl. No.: 11/054,987

(22) Filed: Feb. 9, 2005

(65) Prior Publication Data

US 2005/0172842 A1 Aug. 11, 2005

Related U.S. Application Data

(60) Provisional application No. 60/543,731, filed on Feb. 10, 2004.

(51) Int. Cl.
*B41F 5/00* (2006.01)

(52) U.S. Cl. ..... 101/329; 101/327

(58) Field of Classification Search ..... 101/327, 101/328, 329, 330, 331
See application file for complete search history.

(56) References Cited

U.S. PATENT DOCUMENTS

| | | | |
|---|---|---|---|
| 209,763 | A | 11/1878 | Keeler |
| 321,223 | A | 6/1885 | Keeler |
| 427,229 | A | 5/1890 | French |
| 642,367 | A | 1/1900 | Ray |
| 749,034 | A | 1/1904 | Daut |
| 829,230 | A | 8/1906 | Pope |
| 983,066 | A | 1/1911 | Kjeldaas |
| 1,070,763 | A | 8/1913 | Bauman |
| 1,127,806 | A | 2/1915 | Pells |
| 1,291,057 | A | 1/1919 | Marks |
| 1,576,791 | A | 3/1926 | Rosner |
| 1,656,489 | A | 1/1928 | Low |
| 1,909,326 | A | 5/1933 | Wheeler, Jr. |
| 2,576,622 | A | 11/1951 | McBride |
| 3,167,009 | A | 1/1965 | Sloane |
| 3,465,673 | A | 9/1969 | Oppenheim |
| 3,859,915 | A | 1/1975 | Hunter |

(Continued)

FOREIGN PATENT DOCUMENTS

| | | |
|---|---|---|
| CH | 151703 | 12/1931 |

(Continued)

*Primary Examiner*—Ren Yan
(74) *Attorney, Agent, or Firm*—Michael R. Schacht; Schacht Law Office, Inc.

(57) ABSTRACT

A stamping system for forming a continuous image on an image surface. The stamping system comprises a handle assembly, a stamp wheel, and an inking system. The stamp wheel defines a stamp surface and is rotatably attached to the handle assembly. The inking system comprises a cartridge assembly comprising an inking member, an axle, and a housing member. The inking member defines a through-hole and first and second side surfaces. The axle comprises a center portion and first and second flange portions. The axle supports the inking member such that the center portion lies within the through-hole and the first and second flange portions extend at least partly along the first and second side surfaces. The housing member supports the axle for movement relative to the handle assembly. The inking system further comprises a biasing assembly supported by the handle assembly for applying a force on the housing member such that the inking member comes into contact with the stamp surface.

10 Claims, 5 Drawing Sheets

U.S. PATENT DOCUMENTS

| | | | | |
|---|---|---|---|---|
| 4,181,560 | A | 1/1980 | Maitland | |
| 4,259,568 | A | 3/1981 | Dynesen | |
| 4,367,965 | A | 1/1983 | Speitel | |
| 4,817,526 | A | 4/1989 | Winston | |
| 5,303,648 | A * | 4/1994 | Shih | 101/329 |
| 5,495,800 | A | 3/1996 | Weissbein et al. | |
| 5,732,627 | A * | 3/1998 | Imamaki | 101/328 |
| 5,735,208 | A | 4/1998 | Hummel et al. | |
| 6,234,078 | B1 * | 5/2001 | Kessler | 101/351.6 |
| 6,659,007 | B1 | 12/2003 | Winston | |

FOREIGN PATENT DOCUMENTS

| | | |
|---|---|---|
| DE | 231631 | 11/1909 |
| DE | 551219 | 5/1932 |
| DE | 551947 | 6/1932 |
| DE | 1259732 | 1/1968 |
| FR | 2294857 | 7/1976 |
| GB | 1196169 | 6/1970 |
| IT | 451645 | 9/1949 |

* cited by examiner

CONTINUOUS INK STAMPING SYSTEMS AND METHODS

RELATED APPLICATIONS

This application claims priority of U.S. Provisional Patent Application Ser. No. 60/543,731 filed Feb. 10, 2004.

FIELD OF THE INVENTION

The present invention relates to systems and methods for forming ink impressions on paper and, more specifically, to such systems and methods that employ a stamping wheel that is rolled along an image surface to form a continuous ink impression.

BACKGROUND OF THE INVENTION

The present invention relates to ink stamping systems and methods in which an ink impression is formed on an image surface. The ink is applied to a stamp member on which a design is formed in bas relief. The stamp member with ink thereon is brought into contact with the image surface such that ink is transferred to the image surface to form an ink impression or image in a configuration corresponding to the design on the stamp member. The present invention is of particular importance in the formation of artistic rather than commercial ink impressions. Art stamping uses the same basic ink stamping process as commercial ink stamping but has evolved to allow much finer control over the details and quality of the resulting ink impression. The principles of the present invention may also have application to commercial ink stamping, however.

Ink stamping systems for use by art stampers are designed and constructed primarily to obtain a high quality ink impression, with flexibility of use also being of importance. Considerations such as repeatability of the ink impression, ease of use, and durability of the stamping devices are of lesser importance than in the commercial ink stamping environment.

Ink pad or inking assemblies that form a continuous, repeated ink image are well-known. Such inking assemblies comprise a cylindrical stamping wheel comprising a stamp member defining a cylindrical stamping surface. The design formed in bas relief on the stamp member is formed on the outer surface of the stamp member. The stamp member is mounted on a handle or handle assembly such that the handle can be grasped to roll the stamp member along an ink pad and then along an inking surface to form the desired ink impression on the inking surface. In some continuous inking assemblies, the ink pad is also mounted to the handle such that ink is continuously applied to the outer member of the stamp member as the stamp member rolls along the inking surface.

One such a continuous inking assembly is disclosed in U.S. Pat. No. 4,817,526 for a Rolling Contact Printer with Retractable Inking Wheel. The '526 patent discloses a printing device comprising a print or stamping wheel and an inking assembly. The inking assembly comprises an ink housing and an inking roller that is moveable between a forward position where the inking roller is in contact with the print wheel and a retracted position where the inking roller is spaced from the print wheel. A separate spring is mounted in the housing. The spring urges the inking roller toward the first forward position. A releasable retaining structure is positioned on the ink housing to hold the inking assembly in the retracted position.

A problem with such continuous inking systems is that the inking roller is made of compressible foam that is under pressure during use of the continuous inking system. The foam inking roller can compress unevenly, especially at the edges, and ink may be applied to the print wheel inconsistently. The need exists for improved systems and methods for creating continuously repeating ink impressions.

SUMMARY OF THE INVENTION

The present invention may be embodied as a stamping system for forming a continuous image on an image surface. The stamping system comprises a handle assembly, a stamp wheel, and an inking system. The stamp wheel defines a stamp surface and is rotatably attached to the handle assembly. The inking system comprises a cartridge assembly comprising an inking member, an axle, and a housing member. The inking member defines a through-hole and first and second side surfaces. The axle comprises a center portion and first and second flange portions. The axle supports the inking member such that the center portion lies within the through-hole and the first and second flange portions extend at least partly along the first and second side surfaces. The housing member supports the axle for movement relative to the handle assembly. The inking system further comprises a biasing assembly supported by the handle assembly for applying a force on the housing member such that the inking member comes into contact with the stamp surface.

DETAILED DESCRIPTION OF THE PREFERRED EMBODIMENTS

Figure 1:
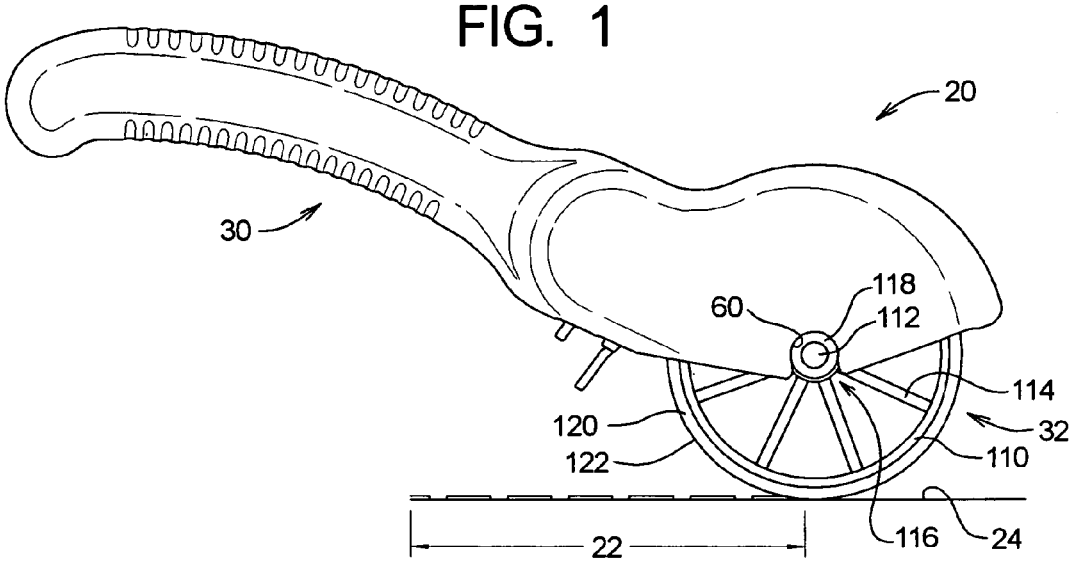
FIG. 1 is side elevation view depicting an inking assembly of the present invention.
Figure 2:
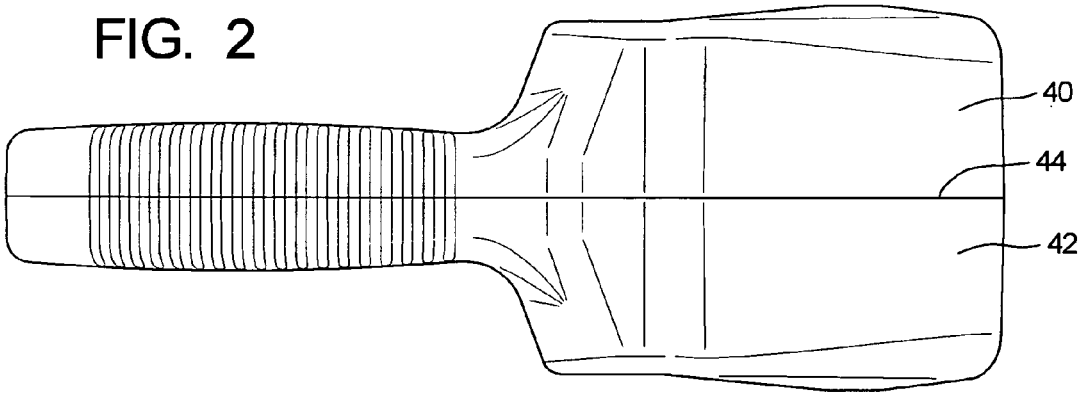
FIG. 2 is a top plan view of the inking assembly of FIG. 1.

Referring initially to FIG. 1, depicted at 20 therein is a stamping system constructed in accordance with, and embodying, the principles of the present invention. The stamping system 20 is used in a conventional manner to form ink images 22 on a surface 24. The method of forming the ink images 22 is not per se a part of the present invention and will not be described herein. In the following discussion, the terms "rear" or "rearward" and "front" or "frontward" refer to directions towards the left and right, respectively, in FIGS. 1–6 and 7–9.

Figure 4:
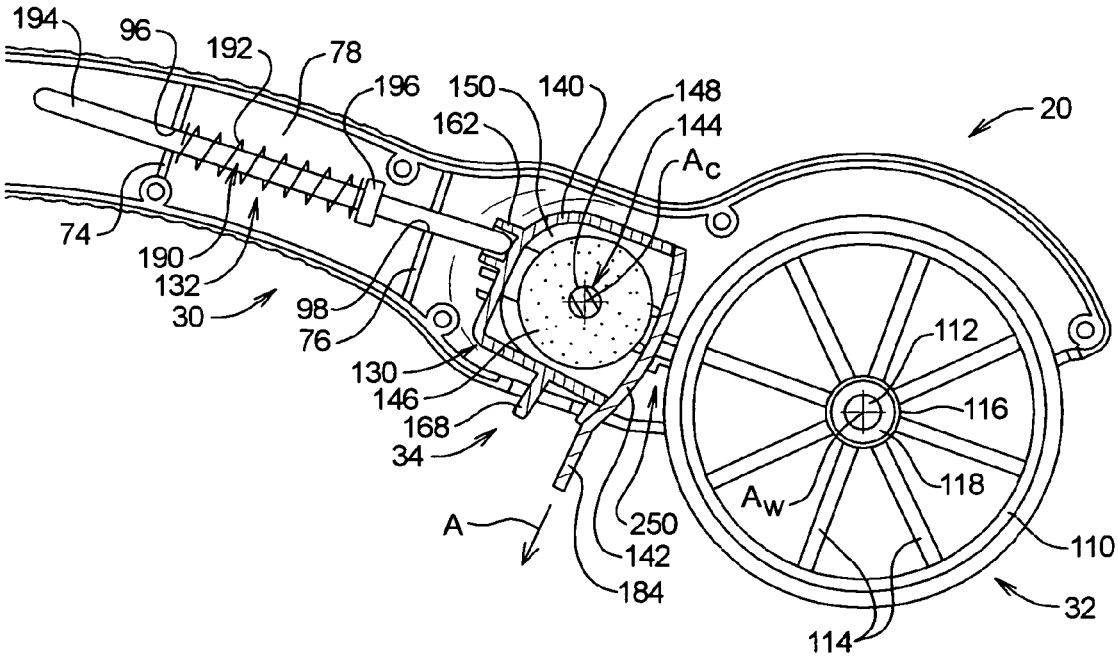
FIGS. 4 and 5 are a side elevation views of the inking assembly of FIG. 1 with a portion of a handle assembly removed.

As perhaps best shown in FIG. 4, the stamping system 20 comprises a handle assembly 30, a stamp wheel assembly 32, and an inking system 34. The handle assembly 30 rotatably supports the stamp wheel assembly 32. The inking system 34 is mounted within the handle assembly 30 such that ink is applied to the stamp wheel assembly 32 as the stamp wheel assembly 32 rotates.

The handle assembly 30 comprises first and second handle portions 40 and 42. The example handle portions 40 and 42 are secured together along a parting line 44 (FIGS. 2 and 3) by a connecting system 46. The example connecting system 46 comprises cavities 48 that receive bosses (not shown) that are received in the cavities 48.

Figure 3:
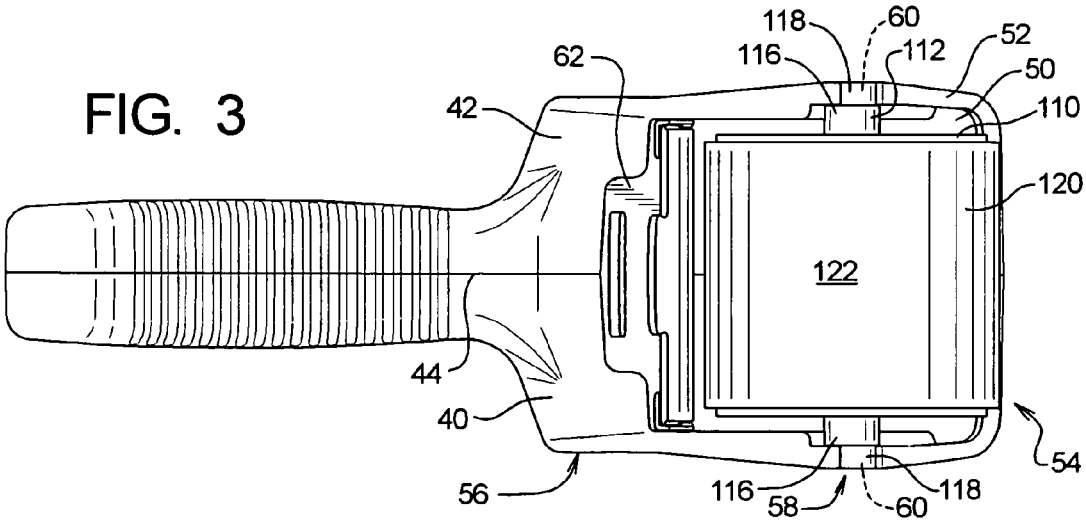
FIG. 3 is a bottom plan view of the inking assembly of FIG. 1.
Figure 7:
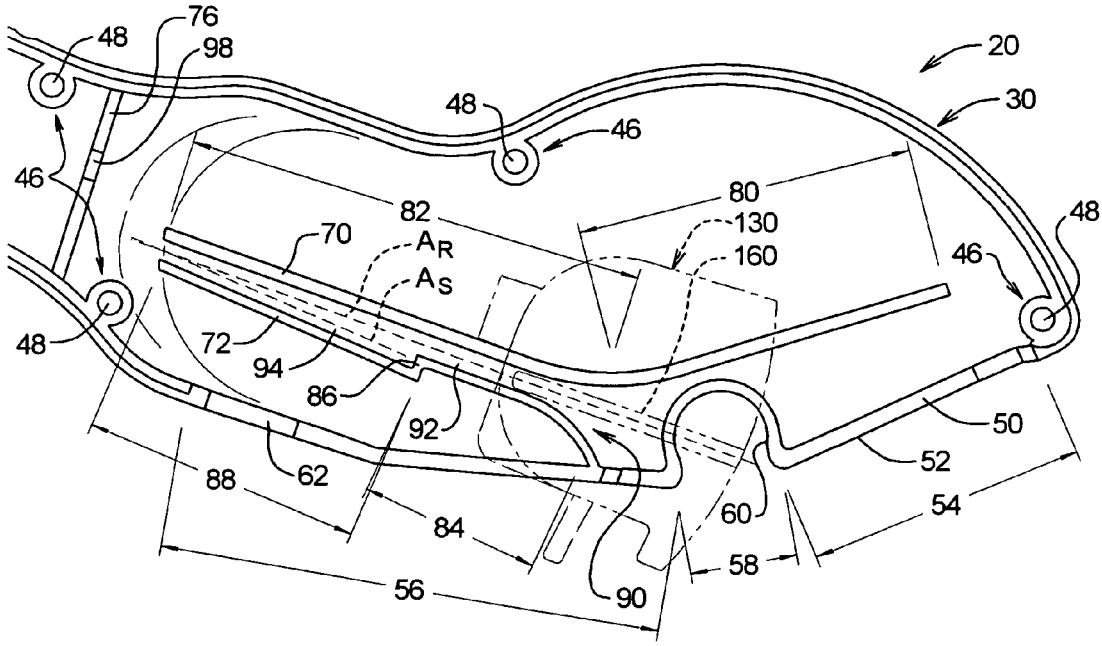
FIGS. 7–9 are side elevation views of a portion of a handle assembly of the present invention illustrating a cartridge assembly in insertion, engaging, and storage positions, respectively.

The handle assembly 30 defines a wheel opening 50 (FIG. 3) circumscribed by an opening edge 52 (FIGS. 3 and 7). The opening edge 52 comprises a front portion 54, a rear portion 56, and intermediate portions 58. The opening edge 52 further defines wheel notches 60 formed at the intermediate portions 58. A cartridge notch 62 is formed in the rear portion 56. As will be described in further detail below, the wheel notches 60 receive and support the stamp wheel assembly 32, while the cartridge notch 62 facilitates access to portions of the inking system 34.

As best shown in FIGS. 4 and 7, the handle portions 40 and 42 each define an upper guide wall 70, a lower guide wall 72, a stop wall 74, and a pin wall 76. When the handle portions 40 and 42 are joined together, a spring chamber 78 is formed between the stop wall 74 and the pin wall 76.

The upper guide wall 70 comprises an opening portion 80 and a channel portion 82. The lower guide wall 72 defines a funnel portion 84, a latch portion 86, and a rear portion 88. The channel portion 82 of the upper guide wall 70 and the funnel, latch, and rear portions 84–88 of the lower guide wall 72 define a cartridge channel 90. The cartridge channel 90 comprises an engaging portion 92 and a storage portion 94.

Figure 8:
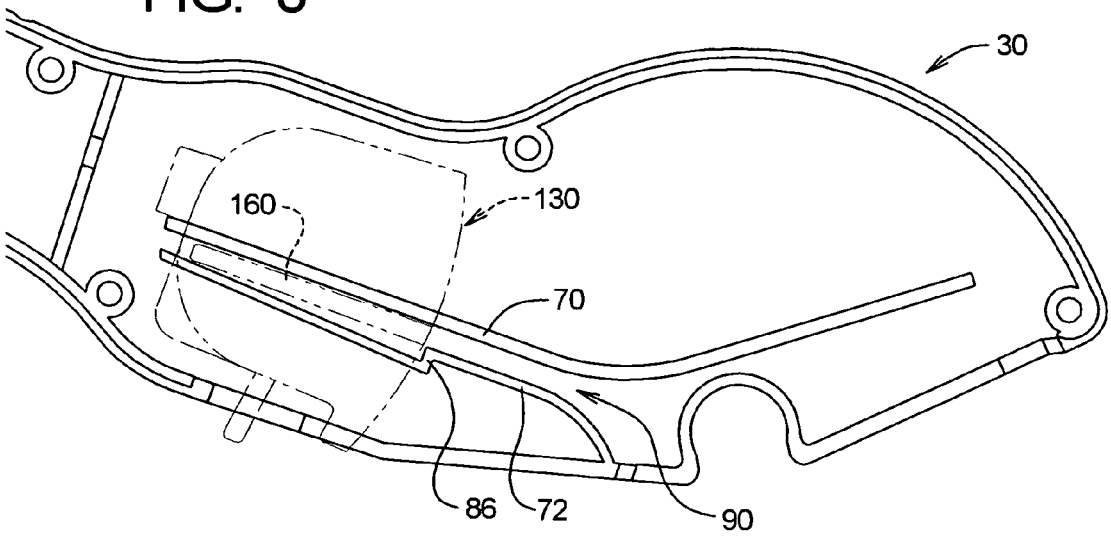
Figure 9:
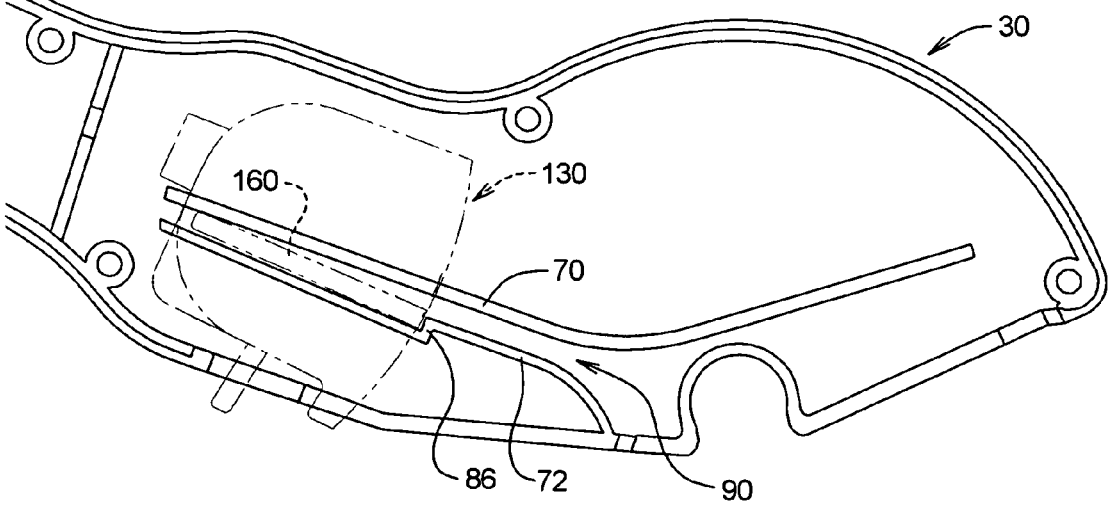
Figure 10:
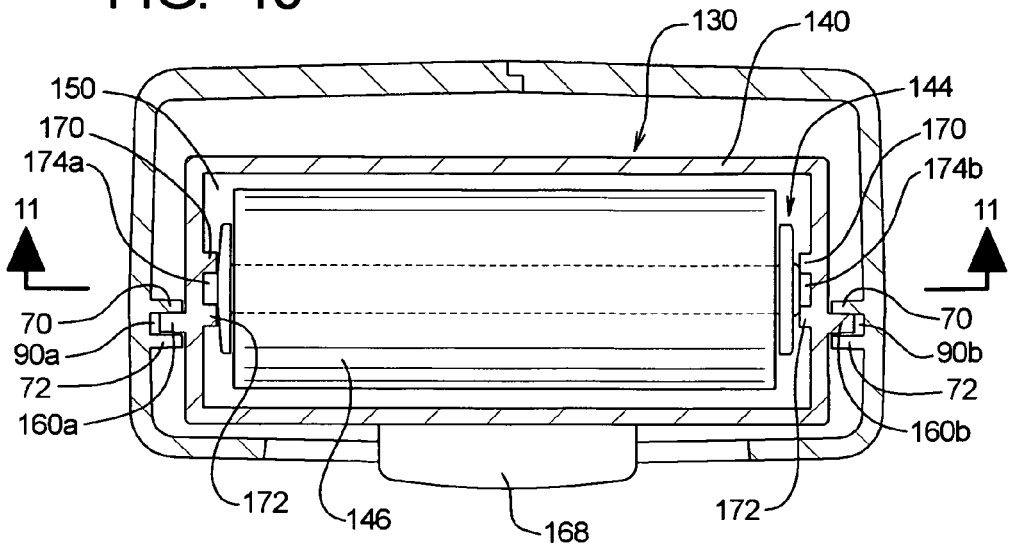
FIG. 10 is a section view illustrating a cartridge assembly and handle assembly of the inking assembly of FIG. 1.

The handle portions 40 and 42 thus define first and second cartridge channels 90*a* and 90*b* as shown in FIG. 10, but only one of the channels 90*a* and 90*b* can be depicted in FIGS. 7–9. The cartridge channels 90 each define a rail axis $A_R$ and a storage axis $A_s$.

When the handle portions 40 and 42 are joined together to form the handle assembly 30, the stop walls 74 define a stop opening 96 and the pin walls 76 define a pin opening 98.

In the example housing system 30, the cavities 48 are formed on the first handle portion 40, while the corresponding bosses are formed on the second handle portion 42. In other respects, the example first and second handle portions 40 and 42 are substantially symmetrical about a plane defined by the parting line 44 as will be apparent from the following discussion.

The handle assembly 30 may be embodied in forms other than those described above. For example, the handle portions 40 and 42 need not be symmetrical about the parting line 44, and the parting line 44 can be formed in other locations. In addition, the connecting system 46 may be formed by any method of connecting two parts together such as adhesives, screws, detent clips, friction, and combinations thereof. As shown and described, the handle assembly 30 can easily be mass produced of injection-molded plastic, but other materials and manufacturing techniques can be used.

Turning now back to FIGS. 1 and 3, the stamp wheel assembly 32 will now be described in further detail. The stamp wheel assembly 32 comprises a wheel drum 110, a wheel axle 112, and wheel spokes 114. The wheel axle 112 is substantially cylindrical and comprises an inner portion 116 and reduced-diameter outer portions 118.

The outer portions 118 of the axle 112 are sized and dimensioned to be snugly received within the wheel notches 60. More specifically, the outer portions 118 snap into the wheel notches 60 to allow the stamp wheel assembly 32 to be detachably attached to the handle assembly 30. With the outer portions 118 so received by the wheel notches 60, the inner portion 116 centers the wheel assembly 32 relative to the wheel opening 50, and the wheel assembly 32 can rotate about the axis of the axle 112 relative to the handle assembly 30.

The wheel drum 110, wheel axle 112, and wheel spokes 114 are all preferably integrally formed of injection-molded plastic, but other materials and manufacturing techniques may be utilized. In addition, these components may be separately manufactured and assembled to form the stamp wheel assembly 32.

A stamp portion 120 is formed on the wheel drum 110. The example stamp portion 120 is a layer of rubber stamp material defining a stamp surface 122. The image 22 is formed in bas relief on the stamp surface 122 in a conventional manner. Different wheel assemblies can be attached to the handle assembly 30 to obtain different images 22.

The example inking system 34 will now be described in further detail with reference to FIGS. 4, 5, 6,10, and 11. The inking system 34 comprises a cartridge assembly 130 and a biasing assembly 132. The cartridge assembly 130 comprises a housing member 140, a cover member 142, an axle assembly 144, and an inking member 146. The inking member 146 defines a through-hole 148.

Figure 5:
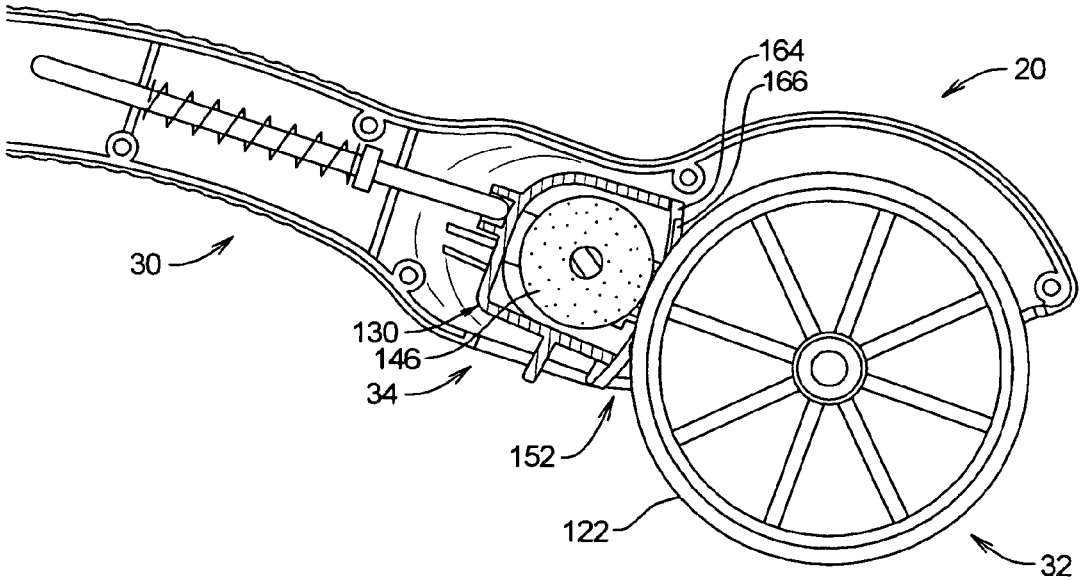
Figure 6:
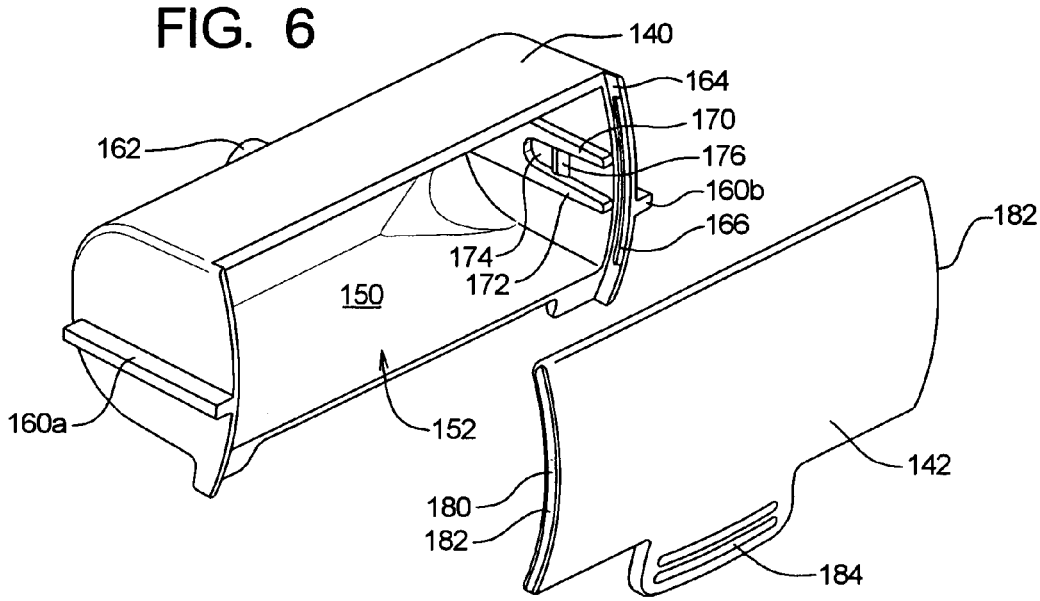
FIG. 6 is an exploded view of a cartridge handle assembly of the present invention.

As perhaps best shown in FIGS. 4 and 6, the example housing member 140 defines a cartridge chamber 150 and a cartridge opening 152. As shown in FIGS. 5 and 6, the housing member 140 further comprises guide rails 160 and a pin socket 162. The housing member 140 further defines housing flanges 164 extending along opposite sides of the cartridge opening 152. Housing ribs 166 extend at least partly along the housing flanges 164. A cartridge grip 168 extends from the housing member 140.

As perhaps best shown in FIGS. 6 and 10, extending from the example housing member 140 within and on opposite sides of the cartridge chamber 150 are pairs of upper and lower axle guides 170 and 172 each defining an axle channel 174. A lock projection 176 extends into each axle channel 174.

FIG. 6 further illustrates that the example cover member 142 defines a cover flange 180 formed on each lateral edge 182 of the member 142. The cover member 142 further comprises a cover handle 184 located between the lateral edges 182.

The housing member 140 and cover member 142 of the example cartridge assembly 130 are made of injection-molded plastic, but other materials and manufacturing techniques may be utilized.

Referring now to FIG. 4, the example biasing assembly 132 will now be described. The biasing assembly 132 comprises a biasing pin 190 and a biasing spring 192. The biasing pin 190 comprises a shaft 194 and a collar 196. The collar 196 bears on the biasing spring 192 during normal use as will be described in further detail below. The biasing pin 190 is preferably made of injection-molded plastic but can be made using other materials and/or other manufacturing techniques. The example biasing spring 192 is a helical metal compression spring, and a portion of the shaft 194 of the biasing pin 190 extends through the center of the biasing spring 192. The biasing spring 192 may also be manufactured using other materials and manufacturing processes.

Figure 11:
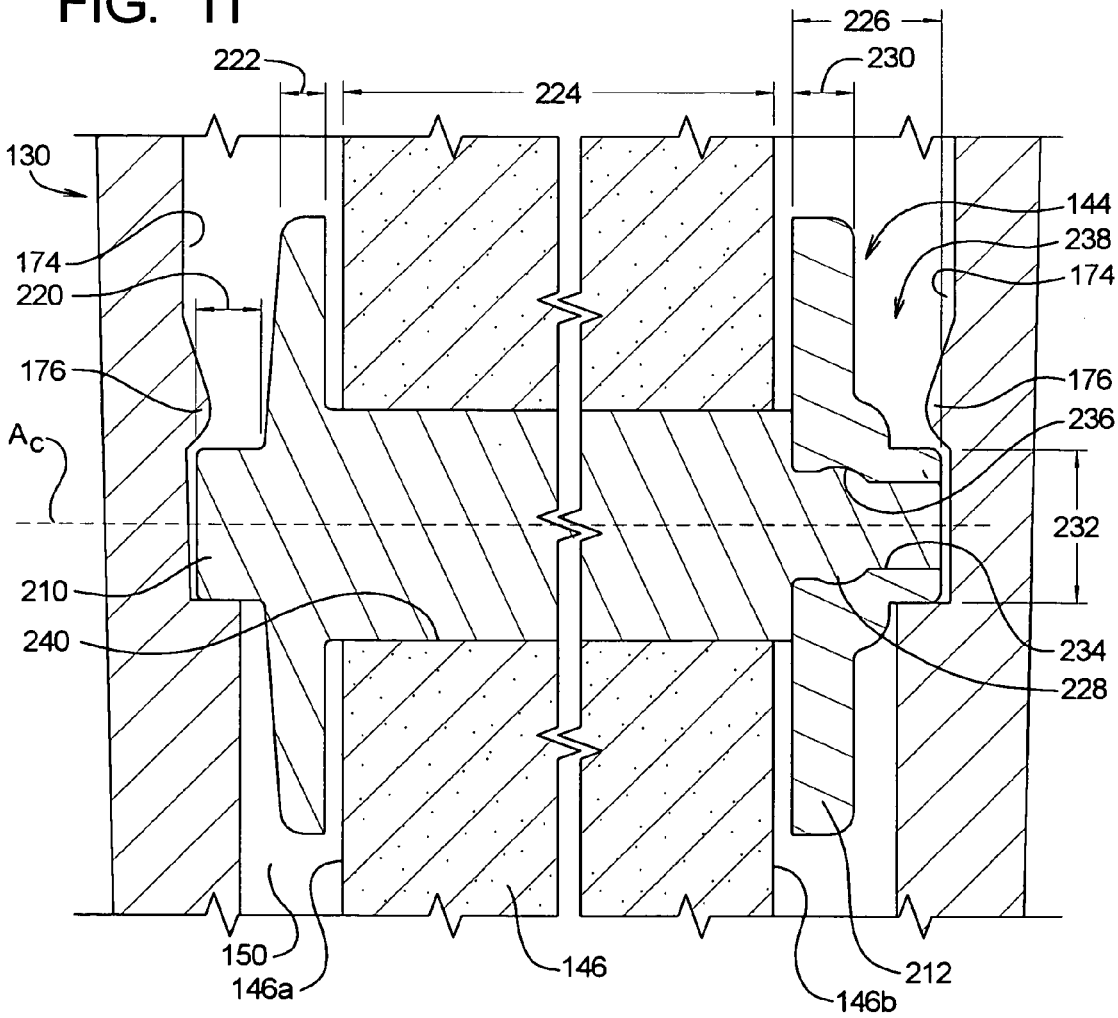
FIG. 11 is a section view of the inking assembly of FIG. 1 taken along lines 11—11 in FIG. 10.

Referring now to FIG. 11, the axle assembly 144 and inking member 146 of the inking system 34 will be described in further detail. The example axle assembly 144 comprises an axle member 210 and an axle cap 212. The axle member 210 comprises a first engaging portion 220, a first flange portion 222, a center portion 224, and a mounting portion 226. A mounting projection 228 extends from the mounting portion 226. The axle cap 212 comprises a second flange portion 230 and a second engaging portion 232. A cap opening 234 extends through the axle cap 212. A mounting cavity 236 is formed on the axle cap 212 within the cap opening 234.

As best shown in FIG. 11, the mounting projection 228 and the mounting cavity 236 form a mounting system 238. The example mounting system 238 forms a snap fit that detachably attaches the axle cap 212 onto the axle member 210.

The axle member 210, axle cap 212, and inking member 146 of the example axle assembly 144 are all substantially symmetrical about a cartridge axis $A_c$ when assembled. In particular, the first and second flange portions 222 and 230 are disc or washer shaped and the center portion 224 and engaging portions 220 and 232 are cylindrical. In addition, the example mounting projection 228 and mounting cavity 236 are annular and have substantially the same cross-sectional areas.

The axle member 210 and axle cap 212 are preferably formed of injection-molded plastic. The axle assembly 144 can be manufactured of other materials and in other configurations, however. For example, an integrally formed axle member defining both of the flange portions can be used in place of an assembly of two parts as described above. Another viable configuration of the axle assembly 144 is to use a single axle member with first and second flange members; the axle member would define the center portion, while the flange members would define the engaging and flange portions.

The mounting system 238 can be eliminated or can take other forms depending upon the structure used to define the engaging portions, flange portions, and center portion. For example, if the engaging portions, flange portions, and center portion are integrally formed on a single part, no mounting system is required. If the engaging and flange portions are formed on separate flange members, the mounting system can be formed by snap fits on each end of an axle member that defines the center portion. And instead of a snap fit, the mounting system can be formed by threads, adhesives, spin-welding, or the like.

The stamping system 20 is assembled as follows. Initially, the shaft 194 of the biasing pin 190 is inserted through the biasing spring 192 until one end of the spring 192 comes into contact with the pin collar 196. The combination of the pin 190 and the spring 192 is arranged such that the pin 190 rests on the stop wall 74 and pin wall 76 of the first handle portion 40 with the spring 192 between the stop wall 74 and pin wall 76.

The second handle portion 42 is then placed on the first handle portion 40 with the stop walls 74 and pin walls 76 engaging each other to form the stop opening 96 and the pin opening 98. The shaft 194 extends through the stop opening 96 and pin opening 98 with the spring 192 contained within the spring chamber 78 as shown in FIG. 4. The handle assembly 30 and biasing assembly 132 are formed at this point. Typically, the handle assembly 30 and biasing assembly 132 are formed at the factory.

The cartridge assembly 130 is separately assembled as follows. Initially, the axle member 210 is displaced such that the mounting portion 226 thereof passes through, and the center portion 224 thereof lies within, the inking member through-hole 240. At this point, the first flange portion 222 is adjacent to a first side surface 146*a* of the inking member 146.

The axle cap 212 is then displaced until the mounting portion 226 of the axle member 210 is received by the cap opening 234 in the cap 212. The application of deliberate force on the axle cap 212 causes the mounting cavity 236 defined by the axle cap 212 to receive the mounting projection 228 defined by the axle member 210. The mounting projection 228 thus positively engages the axle cap 212 to inhibit inadvertent removal of the cap 212 from the axle member 210. At this point, the axle assembly 144 is formed, and the second flange portion 230 is adjacent to a second side surface 146*b* of the inking member 146.

The axle assembly 144 and inking member 146 are then detachably attached to the housing member 140 to form the cartridge assembly 130. In particular, the first and second engaging portions 220 and 232 are displaced along the axle channels 174 formed on the opposite sides of the cartridge chamber 150. When the engaging portions 220 and 232 engage the lock projections 176, further deliberate application of force on the axle assembly 144 deforms the housing member 140 slightly to allow the engaging portions 220 and 232 to pass over the lock projections 176.

After the engaging portions 220 and 232 continue along the axle channels 174 past the lock projections 176, the axle assembly 144 enters a loaded position as shown in FIG. 11. In the loaded position, the axle assembly 144 and inking member 146 rotate relative to the housing member 140, but the lock projections 176 prevent inadvertent removal of the axle assembly 144 from the housing member 140. The axle assembly 144 and inking member 146 can, however, be removed by deliberate application of manual force on the axle assembly 144 to deform the housing member 140, thereby allowing the engaging portions 220 and 232 to pass over the lock projections 176 and out of the axle channels 174.

The cover member 142 is then detachably attached to the housing member 140 by sliding the cover flanges 180 underneath the housing ribs 166 on the housing flanges 164. The cover flanges 180 frictionally engage the housing ribs 166 to inhibit inadvertent removal of the cover member 142 from the housing member 140 (FIG. 4). However, deliberate application of manual force on the cover member 142, and in particular on the cover handle 184, easily allows the cover member 142 to be removed from the housing member 140 (FIG. 5) when desired.

The entire cartridge assembly 130 is then attached to the handle assembly 30 as shown in FIGS. 7–9. In particular, with the stamp wheel assembly 32 removed, the cartridge assembly 130 is inserted through the wheel opening 50 with the guide rails 160 on the housing member 140 generally aligned with the cartridge channels 90 on the handle portions 40 and 42 as shown in FIG. 7. At this point, the pin socket 162 on the cartridge housing member 140 receives a forward end of the pin shaft 194. The opening portion 80 of the upper guide wall 70 and the funnel portion 84 of the lower guide wall 72 facilitate alignment of the guide rails 160 with the cartridge channels 90.

The cartridge assembly 130 is then displaced away from the wheel opening 50 into the handle assembly 30. The guide walls 70 and 72 engage the guide rails 160 such that the rails 160 move and along the rail Axis $A_R$ defined the cartridge channels 90. As the cartridge assembly 130 moves rearwardly into the handle assembly 30, the biasing pin 190 is also displaced rearwardly, and the spring 192 is compressed by the pin collar 196. The cartridge grip 168 and/or cover handle 184 facilitate rearward movement of the cartridge assembly 130 against the force of the spring 192.

Continued movement of the cartridge assembly 130 toward the rear of the handle assembly 30 places the cartridge assembly 130 in a release position relative to the cartridge channel 90 as shown in FIG. 8. In the release position, the cartridge assembly 130 is substantially parallel to the rail Axis $A_R$ of the cartridge channel 90 and is free to move towards the front of the handle assembly 30.

In contrast, FIGS. 4 and 9 illustrate the cartridge assembly 130 in a storage position in which the cartridge assembly 130 is angled slightly with respect to the cartridge channel 90. In the storage position, the cartridge assembly 130 is angled such that it is aligned with the storage Axis $A_S$ defined by the cartridge channel 90, and a portion of the cartridge assembly 130 engages the latch portion 86 of the lower guide wall 72 to prevent frontward movement of the assembly 130 relative to the handle assembly 30. The cartridge assembly 130 is placed into the storage position by tilting or pivoting the cartridge assembly down using one or both of the cartridge grip 168 and/or cover handle 184 and then allowing the biasing spring 192 to force the cartridge assembly 130 against the latch portion 86.

The cartridge notch 62 at the rear portion of the wheel opening 50 accommodates the cartridge grip 168 when the cartridge assembly 130 is in the release and storage positions.

The stamp wheel assembly 32 is or may be conventional, and the construction of the example stamp wheel assembly 32 will not be described herein in further detail. As perhaps best shown in FIG. 4, a gap 250 exists between the cartridge assembly 130 and the stamp wheel assembly 32 when the cartridge assembly 130 is in the storage position. The stamp wheel assembly 32 is thus attached to the handle assembly 30 when the cartridge assembly 130 is in the storage position.

To use the stamping system 20, the cover member 142 is removed from the housing member 140 by applying a force on the cover handle 184 in the direction shown by arrow A in FIG. 4. The cartridge assembly 130 is then placed in the release position, at which point the biasing spring 192 forces the inking member 146 forward into contact with the stamp surface 122 as shown in FIG. 5. As is conventional, the inking member 146 is impregnated with ink that is transferred to the stamp surface 122.

The handle assembly 30 is then displaced such that the stamp surface 122 comes into contact with the image surface 24 on which the image or images 22 are to be formed. The handle assembly 30 is then displaced forward as shown in FIG. 1 such that the stamp wheel assembly 32 rolls about its axle 112. The rotation of the stamp wheel assembly 32 is frictionally transferred to the inking member 146 such that the inking member 146 rotates about the axis of the axle assembly 144 of the cartridge assembly 130. As the stamping system 20 is moved along the image surface 24, ink is continuously transferred from the inking member 146 to the stamp surface 122 and from the stamp surface 122 to the image surface 24.

As is conventional, the inking member 146 is made of a compressible absorbent material impregnated with ink. The compressibility of the inking member 146 allows ink to be evenly distributed on the stamp surface 122. Accordingly, as the stamp wheel assembly 32 rotates and engages the inking member 146, the stamp wheel assembly 32 compresses the inking member 146. The flange portions 222 and 230 engage the first and second sides 146*a* and 146*b* of the inking member 146 to ensure that the inking member 146 does not deform in a manner that does not completely cover the stamp surface 122 with ink.

From the foregoing, it should be apparent that the present invention may be embodied in many different combinations and sub-combinations of the elements and steps described above. The scope of the present invention should thus be determined by the following claims and not the foregoing detailed description.

I claim:

1. A stamping system for forming a continuous image on an image surface, the stamping system comprising:

a handle assembly;

a stamp wheel rotatably attached to the handle assembly, where the stamp wheel defines a stamp surface; and an inking system comprising a cartridge assembly comprising an inking member defining a through-hole and first and second side surfaces, an axle comprising a center portion, first and second flange portions, and first and second engaging portions, where the axle supports the inking member such that the center portion lies within the through-hole and the first and second flange portions extend at least partly along the first and second side surfaces, and a housing member for supporting the axle for movement relative to the handle assembly, where the housing member defines first and second axle channels, and first and second lock projections that extend into first and second axle channels, respectively, where the axle is sized and dimensioned such that first and second engaging portions engage the first and second lock projections, respectively, to deform the housing member, thereby allowing the axle to enter a loaded position relative to the axle housing, where the axle and inking member are attached to the housing member when the axle is in the loaded position, and a biasing assembly supported by the handle assembly for applying a force on the housing member such that the inking member comes into contact with the stamp surface.

2. A stamping system as recited in claim 1, in which the axle comprises:

an axle member defining the center portion, the first flange portion, and the first engaging portion; and an axle cap defining the second flange portion and the second engaging portion.

3. A stamping system as recited in claim 2, in which:

the axle member further defines a mounting portion; and the axle cap is configured to receive the mounting portion of the axle member to detachably attach the axle cap to the axle member.

4. A stamping system as recited in claim 3, in which:

the mounting portion of the axle member defines a mounting projection; and the axle cap defines a cap opening configured to receive the mounting projection on the axle member.

5. A stamping system as recited in claim 4, in which a mounting cavity is formed in the axle cap, where the mounting cavity is sized and dimensioned to receive the mounting projection when the axle cap is attached to the axle member.

6. A stamping system as recited in claim 5, in which the mounting projection and the mounting cavity are annular.

7. A stamping system as recited in claim 1, in which:

the handle assembly defines first and second cartridge channels; and first and second rails extend from the housing member; whereby the first and second cartridge channels receive the first and second rails such that the cartridge assembly moves between operational and storage positions relative to the handle assembly.

8. A stamping system as recited in claim 7, in which the first and second cartridge channels are configured such that the cartridge assembly may be placed in at least one of the following positions:

a storage position in which the cartridge assembly is spaced from the stamp wheel;

a release position in which the cartridge assembly may move towards the stamp wheel; and an operational position in which the inking member is in contact with the stamp wheel.

9. A stamping system as recited in claim 1, in which the biasing system comprises:

a biasing pin supported by the handle assembly for movement between first and second positions; and a biasing spring for assisting movement of the biasing pin towards the first position and opposing movement of the handle assembly towards the second position; whereby the biasing pin engages the housing member such that the housing member forces the biasing pin towards the second position when the cartridge assembly is moved into the release and storage positions.

10. A method of forming a continuous image on an image surface comprising the steps of:

providing a handle assembly;

rotatably attaching a stamp wheel to the handle assembly, where the stamp wheel defines a stamp surface; and providing an inking member defining a through-hole and first and second side surfaces, providing an axle comprising a center portion, first and second flange portions, and first and second engaging portions;

supporting the inking member on the axle such that the center portion lies within the through-hole and the first and second flange portions extend at least partly along the first and second side surfaces;

providing a housing member defining first and second axle channels and first and second lock projections that extend into the first and second axle channels, respectively;

forming a cartridge assembly by displacing the axle into a loaded position relative to the housing member such that the first and second engaging portions engage the first and second lock projections, respectively, to deform the housing member, where the axle and inking member are attached to the housing member when the axle is in the loaded position;

supporting the cartridge assembly for movement relative to the handle assembly; and applying a force on the housing member such that the inking member comes into contact with the stamp surface.

* * * * *